US005890537A

United States Patent [19]

Lavaure et al.

[11] Patent Number: 5,890,537

[45] Date of Patent: Apr. 6, 1999

[54] WIPER PLUG LAUNCHING SYSTEM FOR CEMENTING CASING AND LINERS

[75] Inventors: Gilbert Lavaure; Jason Jonas, both of Houston, Tex.; Bernard Piot, Montrouge, France

[73] Assignee: Schlumberger Technology Corporation, Sugar Land, Tex.

[21] Appl. No.: 805,782

[22] Filed: Feb. 25, 1997

Related U.S. Application Data

[60] Provisional application No. 60/023,886 Aug. 13, 1996.

[51] Int. Cl. [6] ..... E21B 33/00

[52] U.S. Cl. ..... 166/285; 166/383; 166/291; 166/156; 175/202

[58] Field of Search ..... 166/153–156, 166/285, 291, 383; 175/38, 202

[56] References Cited

U.S. PATENT DOCUMENTS

| | | | |
|---|---|---|---|
| 2,630,179 | 3/1953 | Brown . | |
| 3,616,850 | 11/1971 | Scott . | |
| 3,796,260 | 3/1974 | Bradley | 166/202 X |
| 4,479,544 | 10/1984 | Callihan et al. . | |
| 4,624,312 | 11/1986 | McMullin . | |
| 4,671,353 | 6/1987 | Daming . | |
| 4,671,358 | 6/1987 | Lindsey et al. | 166/291 |
| 4,674,573 | 6/1987 | Bode . | |
| 4,709,760 | 12/1987 | Crist et al. . | |
| 4,782,894 | 11/1988 | LaFleur . | |
| 5,095,988 | 3/1992 | Bode | 166/291 |
| 5,497,840 | 3/1996 | Hudson | 166/285 X |
| 5,535,824 | 7/1996 | Hudson | 166/207 |
| 5,613,567 | 3/1997 | Hudson | 166/285 X |

FOREIGN PATENT DOCUMENTS

| | | |
|---|---|---|
| 0377255A1 | 7/1990 | European Pat. Off. . |
| 0450676B1 | 10/1991 | European Pat. Off. . |
| 0500165A1 | 8/1992 | European Pat. Off. . |

*Primary Examiner*—Roger Schoeppel
*Attorney, Agent, or Firm*—John E. Vick, Jr.; Douglas Y'Barbo

[57] ABSTRACT

A wiper plug launching tool includes a body arranged to be lowered into a liner on a running string, the body having a tubular upper portion and a cylindrical lower portion, upper and lower wiper plugs loaded into the lower portion, each of the plugs having upwardly facing elastomer cups that are reduced in diameter during loading, a drive rod movably mounted in the upper portion of the body, a first piston or dart that is pumped down the running string and into engagement with the drive rod so that pressure applied to the first dart forces the rod downward to cause ejection of the lower wiper plug into the liner where cups of the plug expand to provide a moving seal at the lower end of a column of cement, and a second piston or dart that is pumped down into engagement with the first dart to force the rod further downward and cause ejection of the upper wiper plug into the liner where the cups of this plug expand to provide a moving seal at the upper end of the column of cement. A slidable valve is provided adjacent the upper end of the drive rod and is effective to close lateral flow ports upon downward movement of a dart and initial engagement with the drive rod. The drive rod has a piston mounted within a cylinder for cushioned movement upon metering of hydraulic fluid between the piston and cylinder during downward movement of the drive rod. A modification of the invention shown in FIGS. 9–11 utilizes three wiper plugs for sealing the liner.

19 Claims, 5 Drawing Sheets

FIG. 4
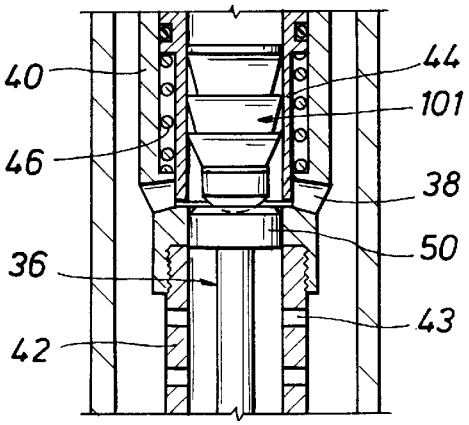
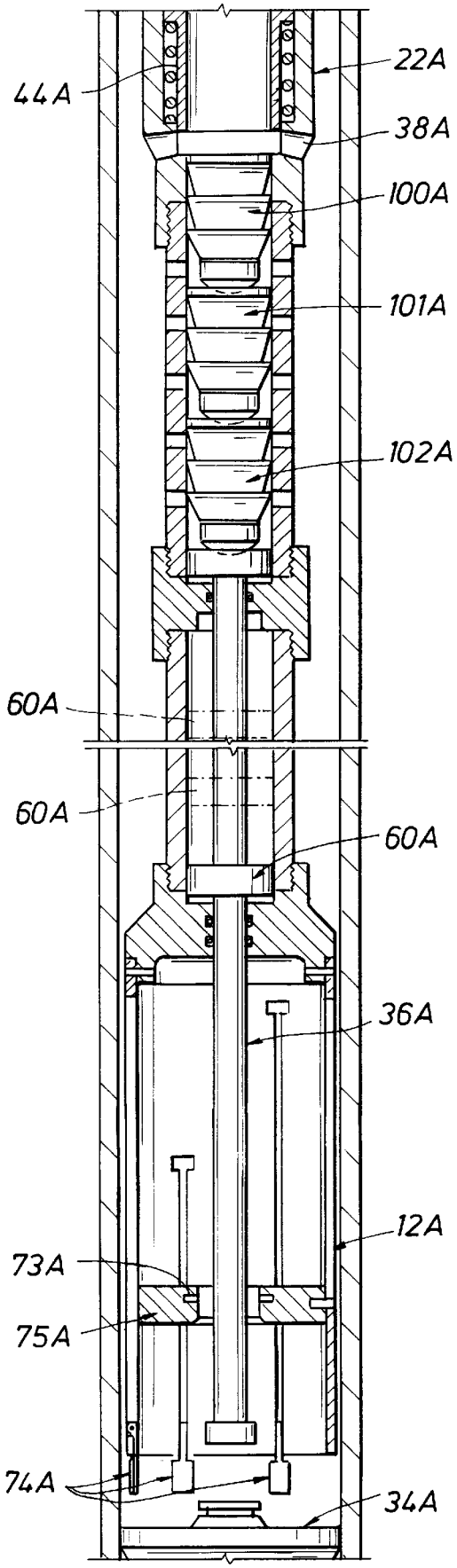
FIG. 11

FIG. 7
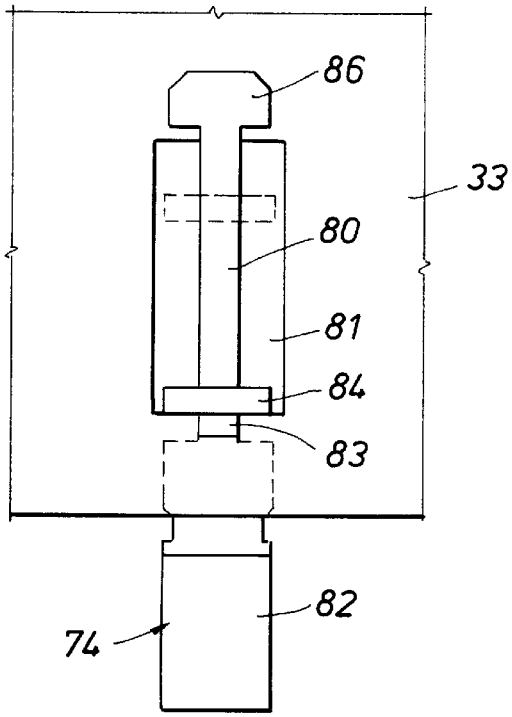
FIG. 6
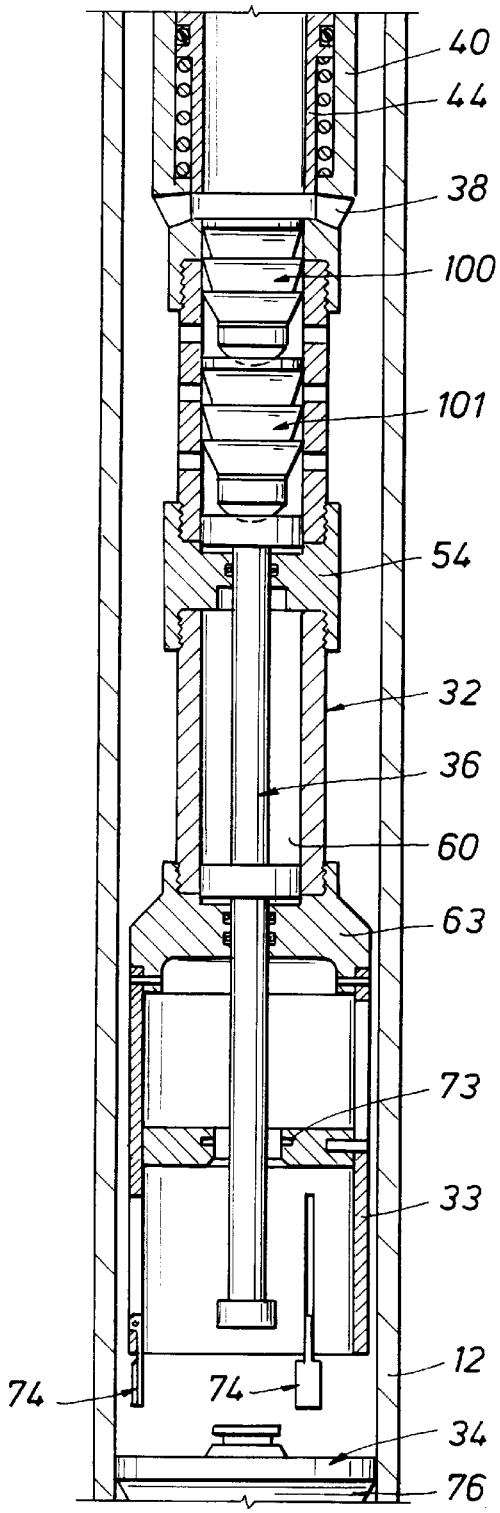
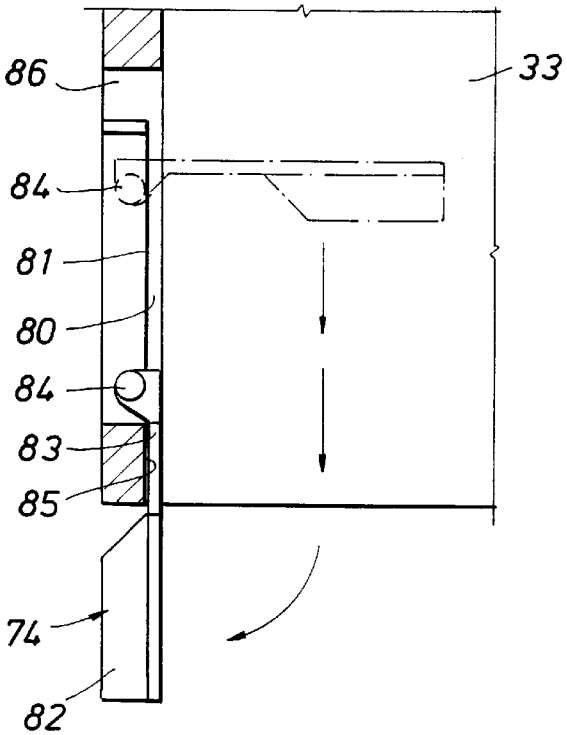
FIG. 8

WIPER PLUG LAUNCHING SYSTEM FOR CEMENTING CASING AND LINERS

CROSS-REFERENCE TO RELATED PROVISIONAL APPLICATION

This application claims the benefit of U. S. Provisional Application No. 60/023,886 filed Aug. 13, 1996 and entitled Cement Plug Launching.

FIELD OF THE INVENTION

This invention relates generally to the cementing of casing strings and liners in petroleum wells, and particularly to new and improved methods and apparatus for launching wiper plugs which prevent contamination of a column of cement slurry by drilling mud as the cement is being pumped into the well during a cementing operation.

BACKGROUND OF THE INVENTION

After a borehole has been drilled into the earth, a string of steel casing or liner is lowered and set therein. One drillable shoe and possibly one drillable collar having an upwardly closing check valve are mounted on or near the lower end of the string to prevent back flow. After the liner has been suspended by a hanger apparatus near the lower end of a previously run casing string, cement slurry is pumped down the interior thereof and out into the borehole via the check valves where it flows up in the annulus outside the liner up to a desired level. The drilling mud that was standing in the well prior to cementing is displaced and circulated out of the well during the casing setting and cementing steps. When the cement has hardened, it seals off the annular space between the outside of the liner and the surrounding well bore wall and prevents migration of formation fluids therealong.

It is highly desirable to protect the cement slurry from contamination by the drilling mud as the slurry is being pumped into the well. The usual practice to protect it is to place a first plug ahead of the cement column which provides a separation between the lower end of such column and the mud, and to place a second plug which performs the same function at the top of the column. Each plug typically has a series of upwardly facing elastomer cups whose outer edges engage the inner walls of the liner to provide sliding seals and wipers. When the first plug lands against a float shoe at the bottom of the liner, a passage is opened up through it which enables cement to be pumped into the annulus. Eventually the second plug lands against the first plug as the displacement is completed. The check valves in the float shoes prevent back flow of the cement into the casing or liner during the time that it takes for the cement to set up. During downward movement the outer edges of the cups of the second plug wipe or scrape the cement off of the inner walls of the liner so that no deposits are left. Once the cement has hardened, the plugs and cement shoes can be drilled out.

Heretofore, wiper plugs used in cementing liners have been designed such that cement slurry and other fluids could be pumped through a flow passage in the plug itself, which requires complicated valve systems to open and close this passage. This complexity has created difficulties in and of itself, and has resulted in plug structures that are difficult to drill out at the end of the cementing operation. The inclusion of such valve structures also has reduced the performance characteristics of such plugs, particularly when the liner hanger and wiper plug launching system are utilized on directional or horizontal sections of a well. For these reasons a person skilled-in-the-art would not run multiple plugs while cementing liners. Only the top shut-off plug would be used in most instances in order to reduce the risk of any mechanical failure. However, not having bottom wiper plugs increases substantially the risk for the cement slurry to channel through the mud inside the liner and therefore be completely contaminated before reaching the annulus. This phenomenon has been responsible for a large number of liner cementing failures.

The general object of the present invention is to provide a new and improved plug launching system of the type described that obviates the above-mentioned problems with prior systems.

SUMMARY OF THE INVENTION

This and other objects are attained in accordance with the present invention through the provision of a casing or liner cementing method including the steps of positioning lower and upper wiper plugs having elastomer cups that are inwardly compressed in an open-bottomed tubular basket near the top of the liner, the basket having an outer diameter that is less than the inner diameter of the liner to permit cement to flow therebetween, the basket having a tubular body extending upwardly therefrom; providing a push rod in the body that can move longitudinally thereof and which has a lower end engaging the upper plug, pumping a first piston or dart down into engagement with the upper end of the rod and then applying pressure to the dart to force the rod downward a selected distance to expel the lower plug from the basket and out into the liner where said cups expand to engage the liner walls and provide a separation between the lower end of a column of cement and the drilling fluids, pumping a certain volume of cement slurry into the liner with said lower plug moving downward at the lower end of the cement, pumping a second piston or dart down into engagement with the first dart, and then applying pressure to force both of the darts and the rod further downward another selected distance to expel the upper plug from the basket and out into the liner where its cups expand to provide a separation between the upper end of the column of cement and the displacing fluids. The cement and plugs then are pumped on down the liner, and when the lower plug seats against a float collar or float shoe, a passage is opened through the plug to enable the cement to flow into the annulus. When the upper wiper plug engages the lower one, the displacement is complete. The basket and body assembly then is retrieved to the surface so that the inside of the liner is unobstructed.

Apparatus in accordance with this invention includes a tubular body having a cylindrical, open-bottomed basket mounted on its lower end. Lower and upper elastomeric wiper plugs are force-fitted into the basket, which temporarily reduces their respective outer diameters. A push rod is mounted for longitudinal movement in the body with its lower end in engagement with the upper plug. The upper end of such rod is adapted to be engaged by a first dart or piston that is pumped down the running string and into the body in order to drive the rod and both wiper plugs downward until the lower plug is expelled from the basket. Upon expulsion, the plug expands radially outward to its relaxed diameter where the outer edges of its cups engage the inner walls of the liner. This plug then moves ahead of a column of cement which is being pumped down the running string and out of lateral ports in the body above the rod. From there the cement flows through the annular space between the basket and the inner wall of the liner. At the appropriate time a second dart or piston is pumped down into the body and engages the first dart. Fluid pressure then is applied to drive the two darts and the rod further downward until the upper wiper plug also is expelled from the basket and launched into the liner at the upper end of the column of cement. This plug expands like the first one to provide a moving seal that prevents contamination of the upper end of the cement column. When the cementing is complete, means are provided to enable the body, the basket, the drive rod and the darts to be retrieved to the surface.

An important feature of the launching tool comprises an upper tubular housing having lateral ports with a slidable sleeve valve mounted within the housing and slidable in the bore of the housing to close or partially close the ports upon downward movement, and to reopen the ports upon movement of a dart past the lateral openings and a return upward movement of the sleeve valve. Thus, fluid pumping pressure is reduced when the ports are reopened after being closed.

Another feature includes a drive rod for ejection of a wiper plug. The drive rod extends within a cylinder tube and within a spacer tube mounted over the cylinder tool. An enlarged diameter upper head or piston of the drive rod is received within the spacer tube and a lower piston of the drive rod is mounted within the cylinder tube. A predetermined clearance is provided between the outer diameter of the lower piston and the adjacent inner peripheral surface of the cylinder tube to provide metering of hydraulic fluid as the drive rod is forced downwardly by a dart engaging the enlarged diameter upper head of the drive rod thereby to cushion the downward movement of the drive rod for ejection of a wiper plug.

BRIEF DESCRIPTION OF THE DRAWINGS

The present invention has the above as well as other objects, features and advantages that will become more clearly apparent in connection with the following detailed description of a preferred embodiment, taken in conjunction with the appended drawings in which:

FIG. 4 is a fragmentary sectional view showing a piston bearing down against the top of the launching rod to shift it downward;

FIG. 6 is a longitudinal sectional view showing the second dart or piston engaging the first to cause ejection of the upper wiper plug;

FIGS. 7 and 8 are views showing the structure and operation of the spacers between the plugs; and At FIGS. 9–11 are sectional views of a separate embodiment of the invention in which three wiper plugs are utilized.

DETAILED DESCRIPTION OF A PREFERRED EMBODIMENT

Figure 1:
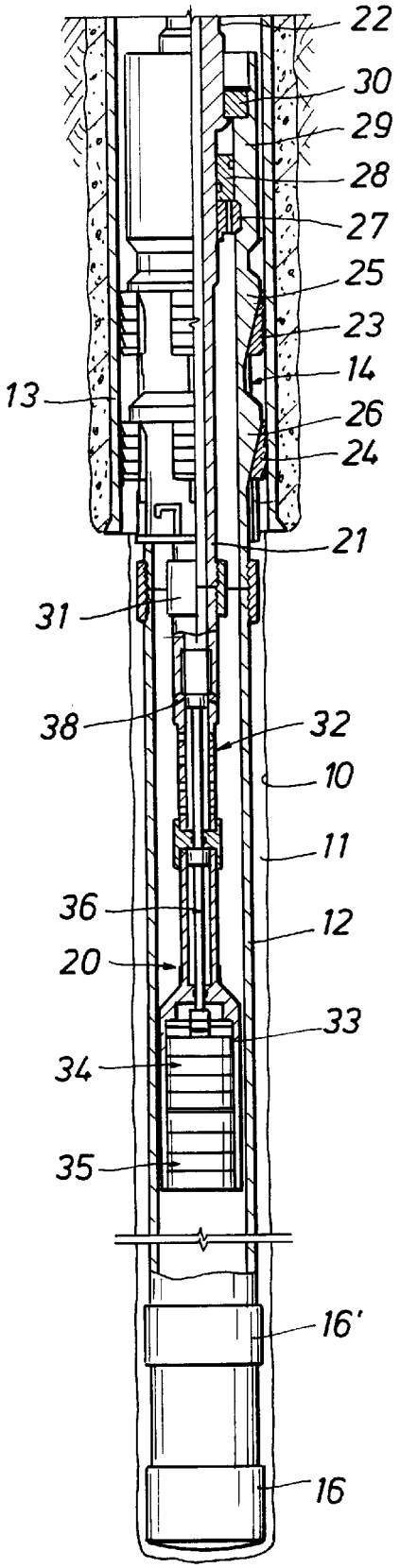
FIG. 1 is a schematic view of a casing or liner being cemented in a borehole using methods and equipment in accordance with this invention.

Referring initially to FIG. 1, a borehole 10 that has been drilled into the earth from an offshore or on land rig has a length of liner 12 disposed therein. The liner 12 is suspended by a hanger indicated generally at 14 that is positioned in the lower portion of the casing 13 that was previously run and cemented in place. The drilling is done using a well-head assembly that in a subsea location is mounted by a base on the sea floor. Various blowout preventers and valves in the well-head are controlled remotely from a vessel or rig by hydraulic lines. The term "liner" as used herein means a well casing whose upper end does not extend all the way to the surface, but is hung off down hole in a larger diameter casing string.

Drillable float shoes or collars 16 and 16' are attached to the lower end of the liner 12 and include an upwardly closing check valves to prevent reverse flow of cement once it has been pumped through the check valves and into the annulus 11 that is formed between the outer diameter of the liner 12 and the walls of the borehole 10. The purpose of the cementing operation is to fill the annulus 11 with cement which then hardens to seal off the annulus so that fluids in the formation rocks that have been penetrated by the borehole 10 can not migrate therealong. After the cementing operation is completed, a portion of the liner 12 can be perforated to bring the well into production, or a smaller diameter borehole can be drilled below the borehole 10 and then lined and cemented to deepen the well.

During the drilling of the borehole 10, it is filled with a weighted drilling fluid or "mud" that has a hydrostatic head which overbalances the formation fluid pressure to prevent a blowout. The mud is circulated to remove cuttings produced by the rotary drilling process. During cementing the mud will be displaced by the slurry and removed from the well. To prevent contamination or mixing of the cement by or with the drilling mud, wiper plugs are positioned at the lower and upper ends of the slurry column to maintain separations. Each plug bridges the bore of the liner 12 and has a plurality of axially spaced elastomeric cups that face upward. The outer edge of each cup is sized to sealingly engage the inner walls of the liner 12 while sliding downward therealong. The tools and methods by which these plugs are launched are constructed and performed in accordance with the present invention.

A plug launching tool indicated generally at 20 in FIG. 1 is attached to the lower end of the mandrel 21 of the hanger setting tool 14 that is connected to the lower end of a running string 22 of drill pipe. The hanger 14 has sets of slips 23, 24 that have serrations or teeth which bite into and grip the casing wall when wedged outward by expander cones 25, 26. Latch dogs 27 and a seal-carrying ring 28 are located between the mandrel 21 and the body 29 of the hanger assembly 14, and a releasable nut 30 couples the body to the running string 22.

The plug launcher 20, which is connected to the lower end of the mandrel 21 by a collar connector 31, includes an elongated generally tubular body 32 whose lower end is connected to a cylindrical housing or basket 33 which has an open lower end. Upper and lower wiper plugs 34, 35 are loaded into the basket 33 during assembly, and are forced into the basket so that elastomer cups are compressed and folded upward to a reduced diameter. The plugs 34, 35 are adapted to be driven sequentially therefrom and into the bore of or the liner 12 by an elongated rod 36 whose upper end is arranged to be engaged by pistons or darts that have been pumped down the running string 22 and the mandrel 21 from the vessel or rig. The first piston or dart that is pumped down drives the rod 36 and both of the plugs 34, 35 down sufficiently to eject only the lower plug from the basket 33, where its cups expand to provide the lower wiper plug. After a known volume of cement has been pumped into the running string 22 where it flows into the liner 12 via the lateral ports 38 and the annular space between the basket 33 and the surrounding inner walls of the liner, another piston or dart is pumped from the surface down into engagement with the first dart. Pressure then is applied to force the rod 36 further down and thereby eject the upper wiper plug 34 so that its elastomer cups expand and engage the inner wall of the liner as it follows the upper end of the cement downward.

Figure 2:
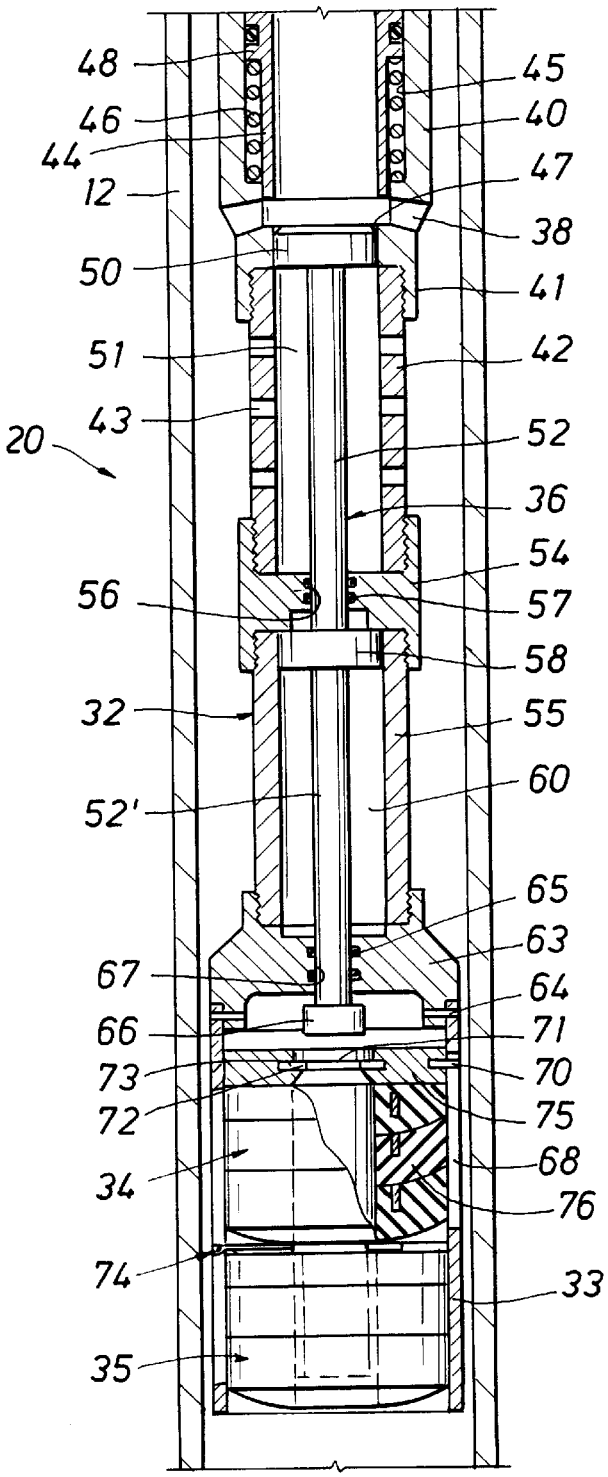
FIG. 2 is a longitudinal cross-sectional view of the plug launching tool of FIG. 1.

As shown in greater detail in FIG. 2, the body 32 of the launching tool 20 includes an upper tubular housing 40 whose upper end is threaded to the mandrel 21 of the liner setting tool 14, and whose lower end is threaded at 41 to a spacer tube 42. A plurality of ports 43 equalize pressures inside and outside the tube 42. A sleeve valve 44 which is slidable in the bore 45 of the housing 40 is biased upward to a normally open position with respect to the ports 38 by a coil spring 46 that reacts between an inwardly extending shoulder 47 on the housing 40 and an outwardly directed shoulder 48 on the upper end of the sleeve valve 44 which also carries a seal ring as shown. In the upper or open position of the sleeve valve 44, cement slurry or other fluids can be pumped down the bore of sleeve valve 44 and into the annular space outside the tool 20 via the ports 38. However the sleeve valve 44 can be moved downward against the bias afforded by the coil spring 46 to a position when its lower end portion partially closes off the ports 38.

The enlarged diameter head or upper piston 50 of the drive rod 36 slides in the bore 51 of the spacer tube 42. A collar 54 connects the spacer tube 42 to the upper end of a cylinder tube 55. The upper portion 52 of the rod 36 extends through a bore 56 in the collar 54, and one or more seal rings 57 prevent fluid leakage. An enlarged diameter lower piston 58 is formed on the rod 36 between its ends, and slides within the bore 60 of the cylinder tube 55. The annular chamber formed between the lower portion 52' of the rod 36 and the inner wall of the tube 55 is filled with a suitable hydraulic oil. The piston 58 has an outer diameter that provides a selected clearance with respect to the wall of the bore 60 such that, as the piston is forced downward with the rod 36, a metering effect is created which retards the rate of downward movement and prevents shock loads from being applied to the wiper plugs 34 and 35.

The lower end of the cylinder tube 55 is connected by threads to an enlarged diameter cap 63 which is, in turn, fixed to the upper end of the basket 33 by radial pins 64 or the like. The cap 63 has a central bore that slidably receives the lower end portion 52' of the drive rod 36. Seals 65 are provided to prevent leakage of hydraulic oil. A drive disc 66 forms the lower end of the rod 36. The basket 33 initially houses the upper and lower wiper plugs 34, 35 within the bore thereof, and is provided with a plurality of longitudinal slots 68 that receive radial stop pins 70 which extend from the outer periphery of a drive flange 75 that rests on top of the upper plug 34. A head 71 on the upper end of the upper plug 34 has an annular recess 72 which receives the inner ends of several radially extending shear pins 73 on the drive flange 75 to releasably couple the plug 34 to the flange. The lower end of the plug 34 is separated from the upper end of the lower plug 35 by several spacer mechanisms 74 to be described in more detail below.

Each of the wiper plugs 34, 35 comprises a plurality of axially spaced, annular elastomer cups 76 that face upwardly. The cups 76 made of an elastomer are molded onto a central core. The relaxed diameter of each cup 76 is slightly greater than the inner diameter of the liner 12 so that the lip of each cup slides and seals against the inner walls of the liner to maintain a separation between fluids above and below the plug. In accordance with one aspect of this invention, the plugs 34, 35 are forcefully loaded into the basket 33 prior to being positioned in the well, and during such loading the cups 76 are deformed radially inward to a diameter that is substantially less than the inner diameter of the liner 12. The resilience of the cups 76 makes each wiper plug fit tightly in the basket 33 so that considerable axial force is necessary to remove them therefrom. However upon release from the basket 33, the cups 76 inherently will resile outward and attempt to attain their slightly oversized outer diameters.

To maintain some spacing between the wiper plugs 34 and 35, the devices 74 shown in FIGS. 7 and 8 are employed. The lower portion of the basket 33 is provided with a plurality of longitudinal, angularly spaced slots 80 that open to the outside through external flats 81. Each spacer 74 includes a generally rectangular bar 82 that has a tang 83 on its outer side which extends through a slot 80. A transverse pin 84 on the head of the tang 83 limits inward movement. The thicknesses of the bars 82 provide an axial separation of the adjacent ends of the plugs 34, 35 to prevent them from sticking together. As the plugs 34, 35 are driven jointly downward in the basket 33, the spacers 74 also move downward from the phantom line position until the bottom plug 35 is ejected from the basket 33. At this point the heads of the tangs 83 encounter the lower end surfaces of the slots 80, and the bars 82 each pivot downward to the solid line positions where the tangs are received in recesses 85. Then the bore of the basket 33 is completely unobstructed during ejection and release of the top wiper plug 34. A window 86 is provided at the top of each slot 80 to provide a space through which the pin 84 can be inserted during initial assembly.

Figure 3:
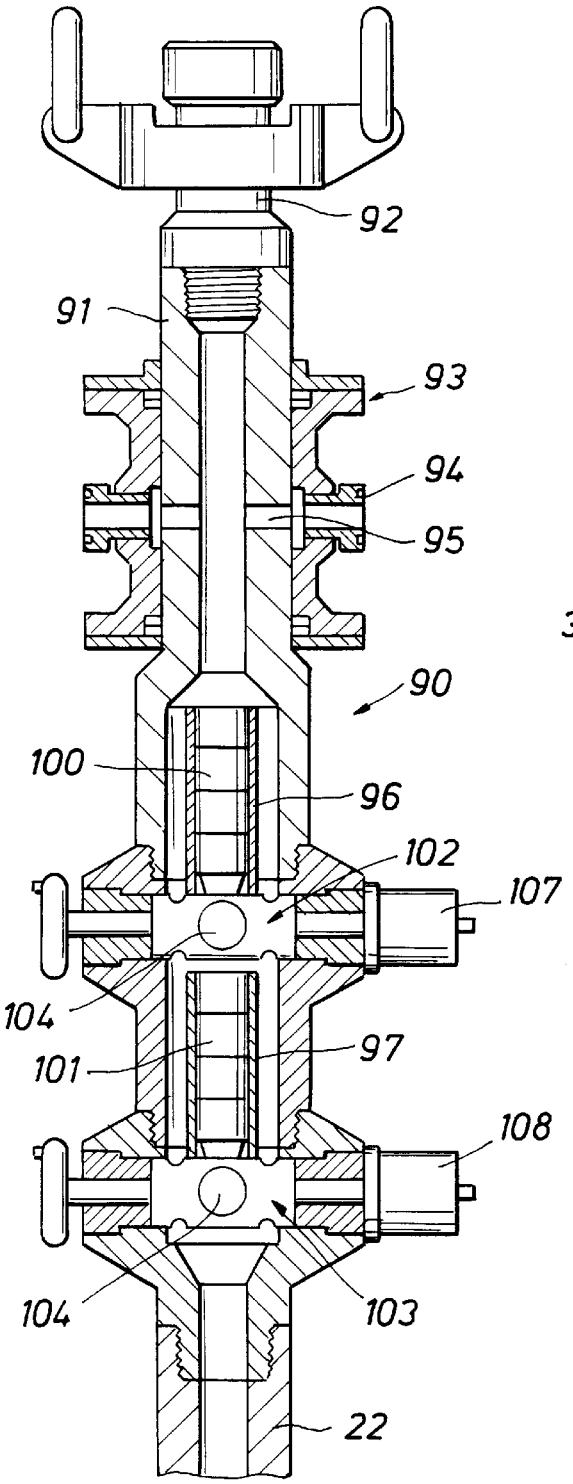
FIG. 3 is a longitudinal sectional view of a surface tool by which the darts or pistons are launched to operate the plug launching tool of FIG. 2.

The plug launching tool 32 of the present invention is remotely operated by releasing pistons or darts from a launcher 90 above the drilling rig floor and then pumping them down the running string 22. As shown somewhat schematically in FIG. 3, the dart launcher 90 includes a generally tubular body 91 whose upper end is connected to a lifting sub 92 by which the body is suspended from the elevators of the rig. A swivel housing 93 that is rotatably mounted on the body 91 has several fluid inlets 94 that communicate with the bore of the body via radial ports 95. Upper and lower tubular receivers 96, 97 which temporarily house the darts 100, 101 are mounting in the body 91 above upper and lower rotatable plug valve elements 102, 103, respectively. The darts 100, 101 are each standard devices having several upwardly facing, elastomer swab cups that hold pressure from above. Each valve element 102, 103 has a passageway 104 that is large enough to pass a dart 100, 101 when the passageway is longitudinally aligned with the bore of a receiver. Suitable actuators 107, 108 are provided to selectively rotate the plug valve elements 102, 103.

The plug valve elements 102, 103 each have kidney-shaped external recesses on opposite sides of the passageways 104 which allow fluids to bypass outside the receivers 96, 97 when the passageways are at right angles to the receivers. This allows fluids to be pumped under pressure into the running string 22 with the darts 100, 101 caged. However when the bypass passages 104 are closed by rotating a valve element until its bore is in alignment with a receiver, pump pressure through inlets 94 forces a dart 100 or 101 out of its receiver, through a valve element and into the running string 22 where it travels down into the upper housing 40 of the wiper plug launcher 20.

Operation

In operation and use of the present invention, the liner 12 is run and suspended by the hanger 14 from a point near the lower end of the casing 13 which is below the wellhead. The hanger 14 is activated by appropriate manipulation of the running string 22, after which the housing 29 is lowered somewhat to cause the cones 25 and 26 to expand the slips 23, 24 into anchoring engagement with the casing 13. The plug launcher tool 20 of the present invention is connected to the lower end of the mandrel 21 as shown in FIG. 1, and the wiper plugs 34 and 35 were previously loaded into the basket 33. The drive rod 36 is in its upper position where the piston 58 is at the upper end of the oil chamber 60. The ports 38 in the housing 40 are open so that fluids can flow therethrough. The running string 22 is coupled to the hanger housing 29 by the nut 30 and the latch dogs 27, and the packing ring 28 prevents any fluid flow up into the casing 13 from the liner 12. The dart launching tool 90 with the two darts 100, 101 loaded into the receivers 96, 97 is connected at the surface between the lifting sub 92 and the upper end of the running string 22. The plug valves 102, 103 are rotated by their actuators to positions that prevent release at the darts 100, 101 while allowing fluid that is pumped in through the swivel inlets 94 to bypass the receivers 96, 97 and the darts and flow down into the running string 22. At this point, conditioning fluids can be circulated down the liner 12 and back up through the annulus outside it to clean up the well 10.

In order to cement the liner 12 in place, cement slurry is pumped in through the dart launcher 90, and then the lower plug valve 103 is opened to release the lower dart 101. As the valve 103 opens, its bypass flow ports are closed, so that pressure is applied to the top of the dart 101 to force it through the valve and down into the drill pipe 22 ahead of the cement. Eventually the dart 101 enters the housing 40, passes into the bore of the valve sleeve 44, and to a position where its nose bumps against the drive head 50 of the rod 36. Since the elastomer cups of the dart 101 seal off the bore of the valve sleeve 44, pressure causes the sleeve valve to shift downward against the bias of the coil spring 46, and in so doing, partially close off the radial ports 38 as shown in FIG. 4.

Figure 5:
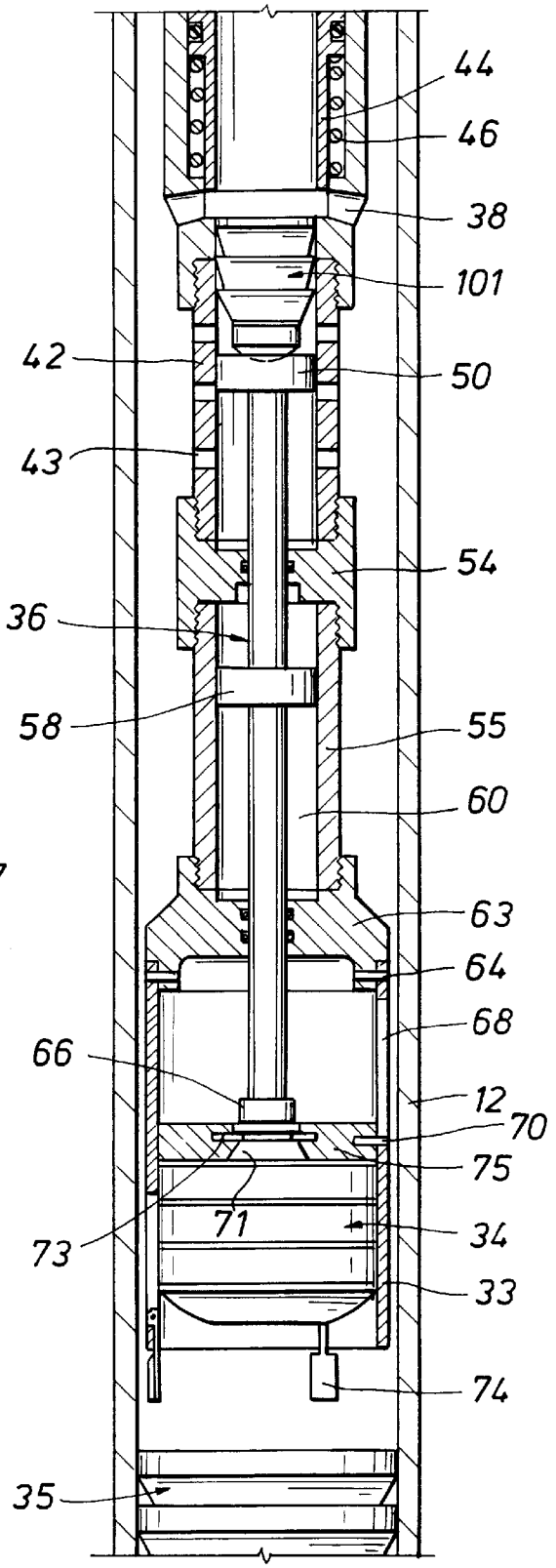
FIG. 5 is a view similar to FIG. 2 showing ejection on the lower wiper plug.

Pressure on the dart 101 applies downward force to the rod 36 and causes it to shift downward in the body 32, thereby driving both the upper and lower wiper plugs 34 and 35 downward. Such movement is slowed by the action of hydraulic oil that meters upward through the clearance between the piston 58 and the inner wall of the cylinder 60 so that shock loads are dissipated. When the pins 70 on the drive plate 75 reach the bottoms of the slots 68 as shown in FIG. 5, downward movement of the upper plug 34 is stopped. However the lower plug 35 will have been ejected from the bottom of the basket 33 and into the bore of the liner 12. After ejection, each cup 76 expands on account of its resilience to bring its outer peripheral edge into sealing contact with the surrounding liner wall. Thus expanded, the plug 35 is pumped down ahead of the cement column to prevent contamination by fluids in the liner 12. At about the same time as the stop pins 70 encounter the bottoms of the slots 68, the top cup of the dart 101 clears the bottom of the sleeve valve 44 so that the ports 38 are re-opened as the sleeve valve is shifted upward by the coil spring 46. The spacers 74 pivot downward to their out-of-the-way positions as shown in FIG. 8 so that the bore of the basket 33 below the plug 34 is unobstructed. Pumping of cement is continued until the desired number of barrels of cement has been placed within the liner 12. When the lower plug 35 reaches the float collar 16', it is stopped thereby and a frangible disc or the like (not shown) in its core ruptures automatically to allow cement to pass on through it.

When the proper amount of cement has been pumped into the running string 22, the upper plug valve 102 of the dart launcher 90 is rotated into alignment with the upper dart 100, which blocks bypass flow and enables this dart to be forced into the drill pipe 22, followed by whatever fluid is being pumped behind it. The dart 100 travels down through the running string 22, the mandrel 21, and into the housing 40. When the cups of the dart 100 enter the valve sleeve 44 and seal off its bore, the valve sleeve shifts downward to close off the lateral ports 38. The dart 100 then engages the lower dart 101, so that applied pressures force the drive rod 36 further down in the body 32 as shown in FIG. 6. The pins 73 are sheared so that the drive disc 66 on the lower end of the rod 32 passes through the plate 75 and forces ejection of the upper wiper plug 34 from the bottom of the basket 33. The cups 76 of this plug then resile outward to seal off the cross-section of the liner bore. The metering of oil past the piston 58 again slows or retards downward movement of the rod 32 so that ejection is smoothed. When the top end of the dart 100 clears the bore of the valve sleeve 44, the valve sleeve again opens, as before, so that displacement fluids flow around the outside of the launcher assembly 20 and through the annular space between the basket 33 and the inner wall of the liner 12. The upper plug 34 also provides a separation so that the cement is not contaminated by such fluids. A positive indication of the launching of wipers plugs 34 and 35 from basket 33 is shown by an increase in pumping pressure at the surface location resulting from the cushioned travel of piston 58 for both plugs 34 and 35. The shearing of pins 73 for upper plug 34 additional increases the pumping pressure for upper plug 34. For example, the increase in the pumping pressure may amount to about 1500 psi for lower plug 35 and to about 3000 psi for upper plug 34.

Continued pumping causes substantially the entire column of cement to enter the annulus outside the liner 12, and completely fill the same as the cement displaces all drilling mud. When the top wiper plug 34 reaches the bottom plug 35 and stops against it, cement in the annulus typically will extend some distance up into the lower end of the casing 13. The liner 12 can be tested for pressure integrity at this time since the upper plug 34 seals off the lower end thereof The check valves in the float shoes 16, 16' prevent back flow. Once the cement has hardened, it seals off the annulus outside of the liner 12 against any migration of fluids along it.

Finally the liner setting tool is released by appropriate manipulation so that it, the plug launching tool 20, and the running string 22, can be removed from the well. If deeper drilling is desired, a bit on a drill string can be used to drill out the plugs 34, 35, the float equipment 16, 16' and any cement remaining in the lowermost end portion of the liner 12. The plug launcher tool 20 is entirely reusable by loading new wiper plugs into the basket 33, and replacing the shear pins 73. The darts 100, 101 are removed from the tool 20 and repositioned in the dart launcher 90.

Separate Embodiment of the Invention

Oftentime, fluids other than drilling fluids may be pumped downhole for various purposes, such as cleaning or conditioning fluids for example. Thus, a separate fluid or fluids may be positioned between the drilling fluid and the cement slurry. For this reason, it may be desirable to have more than two plugs for separation of the several different fluids.

Figure 9:
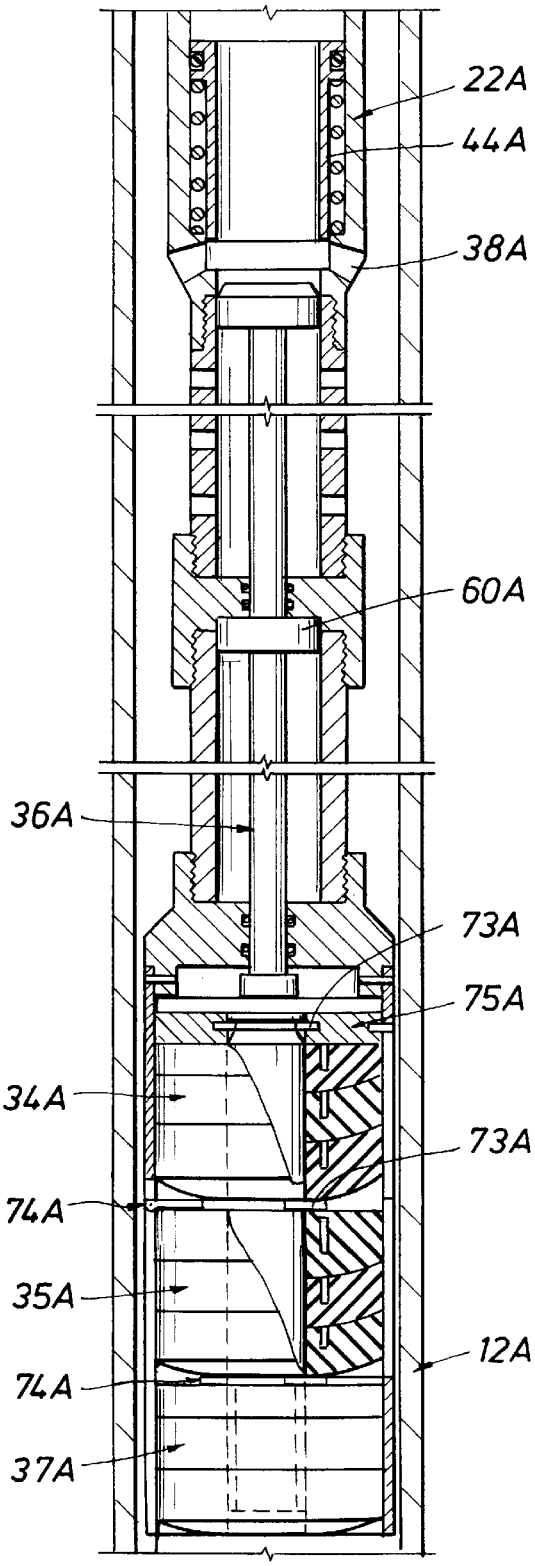
Figure 10:
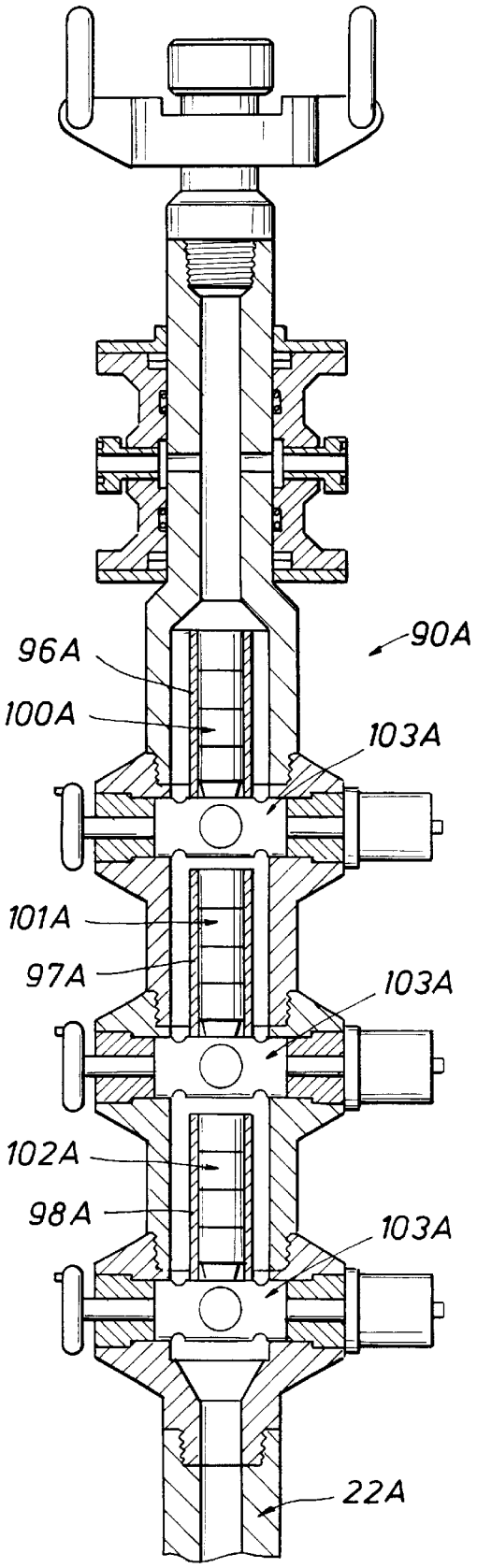

Referring now to FIGS. 9–11, another embodiment of this invention is shown in which three cementing wiper plugs are utilized for fluid separation. A plug launching includes three wiper plugs mounted within a basket defining an upper wiper plug 34A, an intermediate wiper plug 35A, and a lower wiper plug 37A. A driving flange 75A is positioned above plug 34A and includes shear pins 73A. Rod 36A and metering piston 60A function in the same manner as rod 36 and metering piston 60 in the embodiment of FIGS. 1–8. Spacers 74A are positioned between wiper plugs 34A, 35A and 37A.

As shown in FIG. 10, launcher 90A at a surface location such as a floating vessel, for example, has a drill pipe string 22A for extending downwardly within liner 12A which may be on the sea floor in a subsea operation, for example. Three darts 100A, 101A and 102A are mounted within respective tubular receivers 96A, 97A and 98A. Plug valve assemblies 103A are positioned between pistons or darts 100A, 101A and 102A. Pistons or darts 100A, 101A and 102A are released in sequence in a manner similar to the embodiment of FIGS. 1–8. Sleeve valve 44A for ports 38A is provided. FIG. 11 shows the launching tool after darts 100A, 101A and 102A have been launched and wiper plugs 34A, 35A, and 37A ejected from the bottom of the basket. The operation of the launching tool and the associated features not described are similar to the embodiment shown in FIGS. 1–8. Thus, plugs 34A, 35A, and 37A are effective to provide separation between four different fluids. It is of course apparent that additional plugs may be added, if desired, and launched in accordance with the present invention.

It now will be recognized that new and improved wiper plug launching techniques and equipment have been disclosed. Since the wiper plugs initially are mounted in a basket in a manner such that flow is outside of them, difficulties associated with pumping fluids through the inside of plugs are obviated. The design of plugs is greatly simplified, which enables the use of high performance, easily drillable plugs. Since certain changes and modifications may be made in the disclosed embodiments without departing from the inventive concepts involved, it is the aim of the appended claims to cover all such changes and modifications falling within the true spirit and scope of the present invention.

What is claimed is:

1. Apparatus for use in launching a wiper plug into a well casing or liner, comprising: a body having a tubular upper portion and a cylindrical lower portion, said lower portion having an open lower end; wiper plug means including elastomer seal cup means loaded in said lower portion; rod means movably mounted in said upper portion and arranged to engage said plug means; pressure responsive means for forcing said rod means downward to cause said plug means to be ejected from said lower portion; said pressure responsive means including dart means adapted to be pumped down into engagement with said rod means and to move said rod means downward by a distance that is sufficient to eject said plug means; said upper portion of said body including a housing having a bore and a plurality of lateral port means to communicate said bore with the exterior of said body; and sleeve valve means in said bore for opening and closing said ports, said dart means seating in said valve means to cause closing movement thereof and then passing through said valve means as said dart means forces said rod means downward.

2. The apparatus of claim 1 further including means for reopening said sleeve valve means after said dart means has passed through said sleeve valve means.

3. The apparatus of claim 2 further including means for retarding the rate of downward movement of said rod means during ejection of said plug means from said lower portion of said body.

4. The apparatus of claim 2 wherein said dart means comprises a plurality of upwardly facing elastomer cup means arranged in a stack and subject to pump pressure to cause movement of said rod means.

5. Apparatus for use in launching a wiper plug into a well casing or liner, comprising: a tubular body having an open lower end and a cylinder; wiper plug means including elastomer seal cup means loaded in said lower end; a drive rod movably mounted in said cylinder and arranged to engage said plug means; pressure responsive means for forcing said rod downward to cause said plug means to be ejected from said lower end; said pressure responsive means including dart means adapted to be pumped down into engagement with said rod and to move said rod downward by a distance that is sufficient to eject said plug means; a piston on said drive rod mounted within said cylinder for reciprocal movement; and fluid metering means between said piston and said cylinder to provide a cushioned downward movement of said rod during ejection of said plug means.

6. Apparatus as set forth in claim 5 wherein a predetermined clearance is provided between the outer diameter of said piston and the inner peripheral surface of said cylinder to provide fluid metering between said piston and said cylinder upon downward movement of said rod.

7. Apparatus as set forth in claim 5 wherein a spacer tube is mounted over said cylinder, and said rod has an enlarged diameter upper end mounted within said spacer tube for reciprocal movement, said dart means engaging said enlarged upper end for forcing said rod downwardly.

8. Apparatus for use in launching wiper plugs into a well conduit such as a casing or liner during a cementing operation, comprising: a body having a tubular upper portion and a cylindrical lower portion, said lower portion having an open lower end; upper and lower wiper plug means each including elastomeric seal means loaded in said lower portion; rod means movably mounted in the upper portion of said body, said rod means having a lower end in abutting relation to said upper plug means; pressure responsive means for forcing said rod means downward to cause said lower plug means and thereafter said upper plug means to be ejected from said lower portion and into the well conduit; said pressure responsive means including a first dart means adapted to be pumped down into engagement with said rod means and to move said rod means downward by a distance that is sufficient to cause ejection of said lower plug means from said lower portion, and second dart means adapted to be pumped down into downward movement of said rod means by a distance that is sufficient to cause ejection of said upper plug means from said lower portion; said rod means including a piston mounted within a cylinder and a spacer tube mounted over said cylinder, said rod means further including a drive rod connected to said piston and having an enlarged upper end mounted within said spacer tube, said dart means engaging said enlarged upper end for forcing said rod means downward.

9. The apparatus of claim 8 wherein a housing having a bore and a plurality of lateral port means to communicate said bore with the exterior of said body; and sleeve valve means slidable in said bore between positions opening and closing said ports, each of said dart means seating in said valve means to causing closing movement thereof and then passing downward through said valve means to force downward movement of said rod means.

10. The apparatus of claim 9 further including means for reopening said sleeve valve means after each of said dart means has passed through said sleeve valve means.

11. The apparatus of claim 8 further including means providing an axial separation between said upper and lower plug means.

12. The apparatus of claim 11 wherein said means providing an axial separation includes a plurality of inwardly extending spacer elements pivotally mounted on said lower portion for movement from positions between said wiper plug means to positions outside the bore of said lower portion upon ejection of said lower wiper plug means.

13. The apparatus of claim 8 further including plate means in said lower portion above and engaging said upper wiper plug means and being releasably connected thereto; and means on said plate means and said lower portion for stopping downward movement of said upper wiper plug means within said lower portion when said lower wiper plug means has been ejected into the well conduit.

14. The apparatus of claim 13 further including means for releasably connecting said plate means to said upper wiper plug means, said connecting means being released at a predetermined longitudinal force to permit said rod means to move downward through said plate means and eject said upper plug means from said lower portion.

15. The apparatus of claim 8 further including hydraulic means for retarding the rate of downward movement of said rod means to provide absorption of shock loads; said hydraulic means comprising an annular clearance between said piston and cylinder which meters the flow of oil from below to above said piston during downward movement of said rod means.

16. A method of launching a wiper plug into a well conduit such as a casing or a liner, said wiper plug including elastomer cup means, comprising the steps of: providing a body having a tubular upper portion and cylindrical lower portion, said upper portion having elongated rod means movably mounted therein; lowering said body into the well conduit on a tubular running string, loading said wiper plug into said lower portion with said cup means in a reduced diameter condition; positioning said body in the well conduit; then using fluid pressure to pump a dart means down said running string to force said rod means downward and thereby eject said wiper plug from the bottom of said lower portion and into the well conduit where said cup means expand to seal off the cross-section of said well conduit; providing lateral port means in said upper portion of said body through which fluids can flow as said dart means is being pumped down the running string; closing said port means where said dart means engages said rod means; and maintaining said port means closed as said rod means is being forced downward to eject said wiper plug into the well conduit.

17. The method of claim 16 including the further step of reopening said port means to fluid flow once said plug means has been ejected.

18. A method of launching plugs into a well conduit such as a casing or a liner, each of said wiper plugs including elastomer cup means, comprising the steps of: providing a body having a tubular upper portion and a cylindrical lower portion, said upper portion having elongated rod means movably mounted therein; loading each of said wiper plugs into said lower portion with said cup means in a reduced diameter condition; positioning said body in the well conduit; then using fluid pressure to pump dart means downwardly to force said rod means downward and thereby cause sequential ejection of said wiper plugs from the bottom of said lower portion and into the well conduit where said cup means of each of said wiper plugs expand to respectively seal off the cross-section of said well conduit; and providing lateral port means in said upper portion of said body through which fluids can flow as said dart means is being pumped down the running string; and closing said port means while said dart means is applying force to said rod means to cause ejection of a wiper plug into the well conduit.

19. A method of launching at least three wiper plugs from a plug launching tool located down hole in a liner supported from a larger diameter casing string, the plug launching tool being supported from the end of a drill pipe string, the wiper plugs being ejected in sequence from the end of the plug launching pool by a dart for each wiper plug released from a surface location and pumped down the drill pipe string to the associated wiper plug; said method comprising the following steps:

forming said wiper plugs with elastomer cup means;

providing a cylindrical lower portion with an open lower end on said plug launching tool;

loading each of said wiper plugs into said cylindrical lower portion with said cup means in a reduced diameter condition;

positioning said plug launching tool on the end of said drill string within said liner;

releasing a dart from the surface location and forcing said dart down said drill string into said plug launching tool to cause sequential ejection of a wiper plug from the open end of said plug launching tool and into said liner where said cup means expands to seal off the cross section of said liner;

releasing a second dart from the surface location forcing said second dart down said drill string into said launching tool to cause sequential ejection of a second wiper plug from the open end of said plug launching tool and into said liner where said cup means expands to seal off the cross section of said liner at a position above said first wiper plug;

pumping cement down said drill pipe string after release of said second dart and sealing of said liner by said second wiper cup;

then releasing a third dart from the surface location forcing said third dart down said drill string into said plug launching tool to cause sequential ejection of a third wiper plug from the open end of said plug launching tool and into said liner where said cup means expands to seal off a cross section of said liner at a height above said first and second wiper plugs, the third wiper plug being forced downward against the cement slurry to force the cement slurry downwardly and outwardly around the liner;

providing lateral ports in said plug launching tool through which fluids can flow as said dart is being forced down said drill pipe string;

providing means to close said ports immediately before said dart forces a wiper plug out of the lower portion of said plug launching tool; and reopening said ports to fluid flow after ejection of a wiper plug.

* * * * *